US006346370B1

(12) United States Patent
Majumdar et al.

(10) Patent No.: US 6,346,370 B1
(45) **Date of Patent: *Feb. 12, 2002**

(54) ANTISTATIC LAYER FOR A PHOTOGRAPHIC ELEMENT

(75) Inventors: Debasis Majumdar, Rochester; Charles C. Anderson, Penfield, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/633,682

(22) Filed: Aug. 7, 2000

Related U.S. Application Data

(63) Continuation-in-part of application No. 09/305,950, filed on May 6, 1999, now Pat. No. 6,171,769.

(51) Int. Cl.[7] ..... G03C 1/795; G03C 1/89; G03C 1/93

(52) U.S. Cl. ..... 430/529; 430/527; 430/536

(58) Field of Search ..... 430/527, 529, 430/536

(56) References Cited

U.S. PATENT DOCUMENTS

| | | | | |
|---|---|---|---|---|
| 3,525,621 A | | 8/1970 | Miller | 430/527 |
| 3,607,345 A | | 9/1971 | Thomas et al. | |
| 3,630,740 A | | 12/1971 | Joseph et al. | |
| 3,671,248 A | | 6/1972 | Eldridge et al. | 430/536 |
| 4,266,016 A | | 5/1981 | Date et al. | 430/527 |
| 4,547,445 A | | 10/1985 | Asahina et al. | 430/538 |
| 5,045,394 A | | 9/1991 | Saverin et al. | 430/536 |
| 5,156,707 A | | 10/1992 | Kato et al. | 430/536 |
| 5,221,555 A | | 6/1993 | Saverin et al. | 427/209 |
| 5,232,824 A | | 8/1993 | Saverin et al. | 430/529 |
| 5,244,728 A | | 9/1993 | Bowman et al. | 430/529 |
| 5,360,707 A | | 11/1994 | Kato et al. | 430/538 |
| 5,405,907 A | | 4/1995 | Bowman et al. | 430/529 |
| 5,466,536 A | | 11/1995 | Berner et al. | 430/527 |
| 5,683,862 A | | 11/1997 | Majumdar et al. | 430/536 |
| 5,853,965 A | | 12/1998 | Haydock et al. | 430/536 |
| 5,866,282 A | | 2/1999 | Bourdelais et al. | 430/536 |
| 5,874,205 A | | 2/1999 | Bourdelais et al. | 430/536 |
| 6,077,656 A | * | 6/2000 | Majumdar et al. | 430/536 |

FOREIGN PATENT DOCUMENTS

| | | |
|---|---|---|
| GB | 2 132 113 | 7/1984 |

OTHER PUBLICATIONS

Abstract: JP 62 034155 A (Oji Paper Co) Feb. 14, 1987.
Abstract: JP 07 239530 (Fuji Photo Film Co Ltd), Sep. 12, 1995.
Abstract: JP 63 157149 (Oji Paper Co Ltd) Jun. 30, 1988.
Abstract: JP 63 004231 (Oji Paper Co) Jan. 9, 1988.

* cited by examiner

*Primary Examiner*—Richard L. Schilling
(74) *Attorney, Agent, or Firm*—Doreen M. Wells

(57) ABSTRACT

A photographic element having an antistatic layer comprising:

a conductive agent, a colloidal sol, and a polymeric film-forming binder having a peel strength of 400 g or greater on a polypropylene surface.

17 Claims, No Drawings

ANTISTATIC LAYER FOR A PHOTOGRAPHIC ELEMENT

CROSS REFERENCE TO RELATED APPLICATIONS

This application is a continuation-in-part application of U.S. application Ser. No. 09/305,950 filed May 6, 1999, now U.S. Pat. No. 6,171,769, the entire disclosure of which is hereby incorporated by reference. Also, this application relates to commonly assigned copending application Ser. No. 09/305,933, filed May 6, 1999, now U.S. Pat. No. 6,077,656, and hereby incorporated by reference for all that it discloses. In addition, this application relates to commonly assigned copending application Ser. No. 09/306,160 filed May 6, 1999, now U.S. Pat. No. 6,120,979, and hereby incorporated by reference for all that it discloses.

FIELD OF THE INVENTION

This invention generally relates to photographic elements, and more particularly, to a photographic element having an antistatic layer.

BACKGROUND OF THE INVENTION

The problem of controlling static charge is well known in the field of photography. The accumulation of charge on film or paper surfaces leads to the attraction of dirt, which can produce physical defects. The discharge of accumulated charge during or after the application of the sensitized emulsion layer(s) can produce irregular fog patterns or "static marks" in the emulsion. The static problems have been aggravated by increase in the sensitivity of new emulsions, increase in coating machine speeds, and increase in post-coating drying efficiency. The charge generated during the coating process may accumulate during winding and unwinding operations, during transport through the coating machines and during finishing operations such as slitting and spooling.

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivities. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. However, many of the inorganic salts, polymeric electrolytes, and low molecular weight surfactants used are water-soluble and are leached out of the antistatic layers during processing, resulting in a loss of antistatic function.

The conductivity of antistatic layers employing an electronic conductor depends on electronic mobility rather than ionic mobility and is independent of humidity. Antistatic layers which contain conjugated polymers, semiconductive metal halide salts, semiconductive metal oxide particles, etc., have been described previously. However, these antistatic layers typically contain a high volume percentage of electronically conducting materials which are often expensive and impart unfavorable physical characteristics, such as color, increased brittleness and poor adhesion, to the antistatic layer.

Besides antistatic properties, an auxiliary layer in a photographic element maybe required to fulfill additional criteria depending on the application. For example for resin-coated photographic paper, the antistatic layer if present as an external backing layer should be able to receive prints (e.g., bar codes or other indicia containing useful information) typically administered by dot matrix printers and to retain these prints or markings as the paper undergoes processing. Most colloidal silica based antistatic backings without a polymeric binder provide poor post-processing backmark retention qualities for photographic paper.

Yet another important criterion for photographic paper is its spliceability. Heat splicing of photographic paper rolls is often carried out during printing operations and is expected to provide enough mechanical strength to resist peeling as the web goes at high speed through automatic photographic processors following complicated paths including many turns around transport and guide rollers which puts a great deal of stress on the paper. Heat splicing is typically carried out between the silver halide side of the paper and the antistatic backside of the paper. Poor splice strength can cause a number of problems including jamming of automatic processing equipment resulting in machine shut down. Antistatic backings with poor adhesion to the paper base and/or poor cohesive strength are likely to provide inadequate splice strength.

In general, poor adhesion of the antistatic coating onto the resin-coated paper base may be responsible for a number of problems during manufacturing, sensitizing and photofinishing. Poor adhesion or cohesion of the antistatic backing can lead to unacceptable dusting and track-off. A discontinuous antistatic layer, resulting from dusting, flaking, or other causes, may exhibit poor lateral conductivity, and may not provide necessary static protection. It can also allow leaching of calcium stearate from the paper support into the processing tanks causing build-up of stearate sludge. Flakes of the antistatic backing in the processing solution can form soft tar-like species which, even in extremely small amounts, can re-deposit as smudges on drier rollers eventually transferring to image areas of the photographic paper, creating unacceptable defects.

Although the prior art is replete with patents disclosing various antistatic backings for photographic paper (see, for example, U.S. Pat. Nos. 3,671,248; 4,547,445; 5,045,394; 5,156,707; 5,221,555; 5,232,824; 5,244,728; 5,318,886; 5,360,707; 5,405,907 and 5,466,536), not all of the aforesaid issues are fully addressed by these inventions. Also, some of the inventions of the prior art may alleviate one or more problems but may aggravate some others. For example, U.S. Pat. No. 3,525,621 teaches that antistatic properties can be given to an aqueous coating composition by practically any silica sol, but preferably a silica of large surface area of the order of 200–235 $m^2/g$ in combination with an alkylaryl polyether sulfonate. However, the high solubility of the alkylaryl polyether sulfonate in aqueous medium causes leaching during processing resulting in poor backmark retention of such antistatic layers. Similarly, U.S. Pat. No.

5,244,728 teaches a binder polymer consisting of an addition product of alkyl methacrylate, alkali metal salt and vinyl benzene which, when incorporated in an antistatic layer for photographic paper, substantially improves backmark retention characteristics but compromises spliceability and track-off characteristics, as demonstrated in U.S. Pat. Nos. 5,683,862, 5,466,536 teaches of the use of a mixture of polymers and copolymers with specific acrylic acid content for good printabilty. However, the high acid number of these polymers make the antistatic layer (or debris thereof) vulnerable for softening in high pH developer solution, and can cause formation of soft tar-like species discussed herein above.

Moreover, backings developed for one type of polyolefin-coated paper may fail on a different type of polyolefin-coated paper. Therefore, although claims are generally made for both polyethylene and polypropylene coated photographic paper, a vast majority of patents in the art provide examples involving polyethylene coated photographic paper only, and the successful application of these teachings on polypropylene coated photographic paper is often, and even generally, not possible. In general, good adhesion of antistatic layers on a polypropylene surface is more difficult to achieve than on a polyethylene surface. For example, in U.S. Pat. No. 4,547,445 a layer containing gelatin and an inorganic pigment is claimed to have ink-retaining characteristics with good adhesion to polyethylene-coated photographic paper. But, as discussed in U.S. Pat. No. 5,853,965, such a gelatin containing layer is expected to fail adhesion on a biaxially oriented polypropylene-coated photographic paper. However, antistatic layers with good adhesion to a polypropylene surface are expected to have good adhesion to any polyolefin surface including polyethylene, as will be demonstrated through working examples hereinbelow. Antistatic layers containing a styrene-maleic anhydride copolymer, colloidal silica and crosslinking compounds containing ethyleneimino groups and/or epoxy rings are disclosed in U.S. Pat. No. 4,266,016, allegedly for good antistatic characteristics and adhesion on both polyethylene and polypropylene surfaces. However, as demonstrated through comparative samples hereinbelow, such antistatic layers provide neither the backmark retention characteristics nor the spliceability currently desired of photographic paper. Moreover, such formulations raise health and safety concerns due to the usage of crosslinking compounds containing ethyleneimino groups.

Thus, it is clear that the prior art does not fully meet the high demands and the diverse need of the industry and requires further innovation. The objective of the present invention is to provide an antistatic backing for photographic elements, particularly polyolefin-coated photographic paper including both polyethylene-coated and polypropylene-coated paper, that renders backmark retaining characteristics as well as spliceability through improved adhesion to the photographic paper, fulfilling the stringent requirements of the industry.

SUMMARY OF THE INVENTION

The present invention generally relates to an antistatic layer including a (i) conductive agent, preferably a combination of an alkali metal salt and a polymerized alkylene oxide, (ii) optionally a colloidal sol which, if included, is preferably a colloidal metal oxide sol, and (iii) a polymeric film-forming binder with a peel strength of about 400 g or above on a polypropylene surface. Such an antistatic layer can provide surface electrical resistivity of less than 12 log Ω/□ and excellent backmark retention characteristics and spliceability for commercial photofinishing equipment such as the Gretag CLAS 35 printers. The antistatic layer can be incorporated into a photographic element or paper, which may further include a support having a polyolefin coating and at least one silver halide emulsion layer. Particularly, the antistatic layer of the present invention can provide sufficient splice strength, i.e. greater than 75 g, on a variety of surfaces, particularly polyolefin sheets or surfaces coated with various polyolefins, such as polypropylene or polyethylene.

DETAILED DESCRIPTION OF THE INVENTION

While the invention herein finds particular use in the photofinishing industry to print barcodes or other indicia on the back of paper prints by using dot matrix printers for example, it is useful and suitable for applying print or ink markings to any surface wherein the original surface does not possess the desired characteristics. The application with regard to photofinishing has a particularly stringent requirement because the backing layer must survive photographic processing through the automatic processing devices having the harshest conditions in order to be useful.

In photofinishing applications, the coating compositions desirably satisfy the following requirements:

1. The ingredients should be compatible. This can be a particularly stringent requirement when antistatic agents are employed in the coating composition so that the print retaining layer also possesses antistatic properties. The binder polymer in the coating composition in the form of a latex can be easily destabilized causing agglomeration of the latex particles to occur.

2. The coatings should be alkali resistant up to a pH of 10 to survive the photographic processing solutions.

3. The coatings should be resistant to discoloration due to processing solutions and/or aging.

4. The coatings should be able to receive and retain ink or other marking materials through the photographic processing.

5. The coatings should not be photoactive and interfere with the light sensitive portions of the photographic paper.

6. The coatings should have a resistivity of less than 12 log Ω/□.

7. The backside coating should be spliceable to the frontside in commercially available splicing devices and maintain sufficient peel strength.

8. The coatings should be resistant to track off during conveyance by various roller/nip transport machines during manufacturing of the photographic paper and also in the development processor.

9. The coatings should be block resistant in the rolled form. That is, in preparation of printing paper for use in photographic applications, the paper in processing is rolled upon itself. It is desirable that the write retaining layer does not block together with the opposite surface of the paper support.

10. The coatings should have a stability of at least 6 to 12 months in order to be commercially acceptable.

The coatings and the coating compositions according to this invention generally satisfy these requirements by utilizing a (i) conductive agent, preferably a combination of an alkali metal salt and a polymerized alkylene oxide, (ii) a colloidal sol, preferably a colloidal metal oxide sol and (iii) a polymeric film-forming binder with a peel strength of 400 g or above on a polypropylene surface, which the antistatic layer of the present invention is preferred to be formed.

The electrically conductive agent as per the present invention can include any of the antistatic agents known in the art, including but not limited to those mentioned hereinabove. Ionic conductors are traditionally more cost effective than electronic conductors. Among the ionic conductors, ammonium salts, alkali metal salts of polyacids, such as, lithium, sodium or potassium salt of polyacrylic or polymethacrylic acid, maleic acid, itaconic acid, crotonic acid, polysulfonic acid, polystryrene sulfonic acid, or mix polymers of these compounds, as well as cellulose derivatives are effective conductive agents. The alkali salts of polystyrene sulfonic acid, napthalene sulfonic acid or an alkali cellulose sulfate are preferred. The combination of polymerized alkylene oxides and alkali metal salts, described in U.S. Pat. Nos. 4,542,095 and 5,683,862 incorporated herein by reference, is also a preferred choice. Of the latter group, a combination of a polyethylene ether glycol with lithium nitrate is the most preferred choice for an antistatic agent. The weight ratio of the alkylene oxide to alkali metal salt in the dried antistatic layer can be between 5:95 to 95:5, but preferably between 20:80 and 80:20, and more preferably between 40:60 and 60:40. The combined weight of the alkylene oxide and the alkali metal salt as the electrically conductive agent can be 1–50% of the weight of the dried antistatic layer but preferably between 2–20%, and more preferably between 5–15% of the weight of the dried antistatic layer. The alkali metal salt of the polyacid as the electrically conductive agent can be 1–50% of the weight of the dried antistatic layer but preferably between 2–30%.

The colloidal sol utilized in the present invention comprises finely divided solid inorganic particles in a liquid medium. As used herein, the term "colloidal sol" means an aqueous colloidal dispersion of finely divided inorganic particles of ultramicroscopic size. Preferably, the particles are in an aqueous medium. Most preferably, the inorganic particles are inorganic metal oxide particles. Inorganic metal oxides particularly suitable for use in the present invention include tin oxide ($SnO_2$), titania, antimony oxide ($Sb_2O_5$), zirconium oxide ($ZrO_2$), cerium oxide, yttrium oxide, zircon ($ZrSiO_4$), silica, alumina-coated silica, boehmite (alpha-$Al_2O_3.H_2O$), as well as other inorganic metal oxides of Groups III and IV of the Periodic Table and mixtures thereof. The selection of the inorganic metal oxide is dependent upon the ultimate balance of properties desired, including cost. Inorganic particles such as silicon nitride, silicon carbide, and magnesium fluoride when in sol form are also useful in the present invention.

The solid inorganic particles have an average particle size less than 100 nm, preferably less than 70 nm, and most preferably less than 40 nm. A variety of colloidal sols useful in the present invention are commercially available from DuPont, Nalco Chemical Co., and Nyacol Products Inc.

The binder for the antistatic layer can be any film-forming polymer, having a peel strength of 400 g or above on a polypropylene surface, which the antistatic layer is preferred to be formed. Desirably, the binder has a peel strength of 500 g or above on a polypropylene surface. More desirably, the binder has a peel strength of 700 g or above on a polypropylene surface. However, such a polymeric binder is suitable for use in antistatic layers to be formed on any polyolefin surface including polyethylene, as per the present invention. The peel strength is measured following a practical method described herein below. The binder polymer can be one or more of a water soluble polymer, a hydrophilic colloid or a water insoluble polymer, latex or dispersion. Particular preference is given to polymers selected from the group of polymers and interpolymers prepared from ethylenically unsaturated monomers such as styrene, styrene derivatives, acrylic acid or methacrylic acid and their derivatives, olefins, (meth)acrylonitriles, itaconic acid and its derivatives, malcic acid and its derivatives, vinyl halides, vinylidene halides, and others. Also included are aqueous dispersions of condensation polymers such as polyurethanes and polyesters.

Peel Strength Measurement

The peel strength of the binder polymer is determined by the following practical method. The binder polymer is coated at a dry coverage of 1.0 g/m$^2$ on the polypropylene surface of a polypropylene coated photographic paper. The surface of the polypropylene should be treated prior to coating of the binder polymer by the same means as intended for the practice of the present invention for improved adhesion of the antistatic layer onto the photographic paper. Such means could include any of the known methods of the art e.g., acid etching, flame treatment, corona discharge treatment, glow discharge treatment, etc, of the polyolefin surface and/or coating with a suitable primer layer. If other ingredients such as crosslinking agents, surfactants, defoamers, plasticizers, etc. are to be incorporated in the antistatic layer, these additional ingredients should be included in the binder polymer coating. After proper drying, the binder polymer layer is spliced against a typical photographic paper, with the surface of the binder polymer layer being in contact with the surface of the photographic emulsion on the paper, using a splicing module similar to that used in a typical photofinishing equipment such as the Gretag CLAS 35 printer. Splicing is carried out at a pressure of 0.276 MPa (or 40 psi) with 4 seconds of heating and 4 seconds of cooling, replicating the conditions used in trade. The peel strength of the resultant splice is determined in an Instron machine, using multiple samples of 13 mm width and 10 cm gauge length, as the force (measured in grams) necessary to peel the two strips apart, using a crosshead speed of 50 mm/min. It was found that, as per the present invention, polymers with a peel strength of about 400 g or above on a polypropylene surface can be used as the binder polymer for the antistatic layer for photographic paper, desirably coated with any polyolefin such as polypropylene, polyethylene and mixtures thereof. Preferably, the photographic paper is coated with polypropylene or polyethylene.

The dry weight ratio of the colloidal sol:binder polymer in the antistatic layer can vary from 0:100 to 95:5, but preferably between 5:95 to 95:%, and more preferably between 10:90 to 90:10. The total dry weight % of the colloidal sol and the binder combined should be between 99% and 5% but preferably between 98% and 50% of the antistatic layer.

The dry coverage of the antistatic layer of the present invention can be from 10 mg/m$^2$ to 10,000 mg/m$^2$, but preferably from 100 mg/m$^2$ to 1000 mg/m$^2$.

In addition, the coating composition of the present invention may include tooth-providing ingredients (see U.S. Pat. No. 5,405,907, for example), colorants, crosslinking agents, surfactants and coating aids, defoamers, thickeners, coalescing aids, matte beads, lubricants, pH adjusting agents and other ingredients known in the art.

The coating solution for forming the antistatic layer of the present invention on resin-coated photographic paper can be aqueous or non-aqueous; however, aqueous solutions are preferred for environmental reasons. The surface on which the coating solution is deposited for forming the antistatic layer can be treated for improved adhesion by any of the means known in the art, such as acid etching, flame treatment, corona discharge treatment, glow discharge treatment, etc, or can be coated with a suitable primer layer.

However, corona discharge treatment is the preferred means for adhesion promotion.

The antistatic layer of the present invention can be formed on any hydrophobic support, for example, synthetic papers such as polypropylene and polystyrene, films such as cellulose acetate, polyethylene terepthalate, polyethylene napthalate, polyvinyl acetate, polystyrene and polycarbonate, resin coated papers comprising paper as a substrate coated on both sides with film forming resins such as polyolefin, polyvinyl chloride, etc. The invention is most suitable for polyolefin coated paper most commonly used in photographic industry, and most particularly polypropylene coated paper.

As an example, the support can be a paper base sandwiched by two polyolefin layers. Each polyolefin layer can be a homogenous layer, e.g. polypropylene; or can further comprise homogeneous or heterogeneous layers of polyolefins, such as layers of polypropylene and polyethylene. The polyolefin layer can also be a biaxially oriented sheet. Desirably, at least one polyolefin layer bonds to gelatin that can be present in a photosensitive silver halide layer.

The aforementioned resin layer may preferably contain, in suitable combination, various additives, for instance white pigments such as titanium oxide, zinc oxide, talc, calcium carbonate, etc., dispersants for example fatty amides such as stearamide, etc., metallic salts of fatty acids such as zinc stearate, magnesium stearate, etc., pigments and dyes, such as ultramarine blue, cobalt violet, etc., antioxidant, fluorescent whiteners, ultraviolet absorbers.

The polyolefin resin coated papers as per this invention can be prepared by extrusion coating or laminating one or more layers of polyolefin resin on substrate paper. The surface of the substrate paper can be treated for improved adhesion prior to resin coating by any of the known methods of the art, e.g., acid etching, flame treatment, corona discharge treatment, glow discharge treatment, etc. The side of the polyolefin resin coated paper on which photographic emulsion layers are provided may have a gloss surface, matte surface, silk-like surface, etc. and the backside usually has, but is not limited to, a dull surface.

Suitable polyolefins for the present invention include polyethylene, polypropylene, polymethylpentene, polystyrene, polybutylene and mixtures thereof. Polyolefin interpolymers, including interpolymers of propylene and ethylene such as hexene, butene and octene are also useful. The present invention is particularly suitable for photographic paper comprising biaxially oriented microvoided polypropylene layer(s), as disclosed in U.S. Pat. Nos. 5,853,965, 5,866,282 and 5,874,205 incorporated in their entirety herein by reference. The present invention is also suitable for supports such as those disclosed in U.S. Pat. Nos. 5,888,681; 5,888,683; 5,902,720; 5,935,690; 5,955,239; 5,994,045; 6,017,685; 6,017,686; 6,020,116; 6,022,677; 6,030,742; 6,030,756; 6,030,759; 6,040,036; 6,043,009; 6,045,965; and 6,063,552.

The substrate paper may comprise normal natural pulp paper and/or synthetic paper which is simulated paper made from synthetic resin films. However, natural pulp paper mainly composed of wood pulp such as soft wood pulp, hard wood pulp, and mixed pulp of soft wood and hard wood, is preferred. The natural pulp may contain, in optional combination, various high molecular compounds and additives, such as, dry strength increasing agents, sizing agents, wet strength increasing agents, stabilizers, pigments, dyes, fluorescent whiteners, latexes, inorganic electrolytes, pH regulators, etc.

The coating compositions of the invention may be applied by any well known coatings method such as air knife coating, gravure coating, hopper coating, roller coating, spray coating, and the like.

While different photographic elements may require different coverages, the present invention may be applied to both color and black and white photographic papers with adjusted coverage values depending on the particular application.

Without further elaboration, it is believed that one skilled in the art can, using the preceding description, utilize the present invention to its fullest extent. The following examples are, therefore, to be construed as merely illustrative and not limitative of the remainder of the disclosure in any way whatsoever.

In the foregoing and in the following examples, unless otherwise indicated, all temperatures are set forth uncorrected in degrees Celsius and all parts and percentages are by weight.

The entire disclosures of all applications, patents and publications, cited above or below, and application Ser. No. 09/305,950, filed May 6, 1999, are hereby incorporated by reference.

Test Methods

For resistivity tests, samples are preconditioned at 50% RH 72° F. for at least 24 hours prior to testing. Surface electrical resistivity (SER) is measured with a Keithly Model 616 digital electrometer using a two point DC probe by a method similar to that described in U.S. Pat. No. 2,801,191. An SER value of less than 12 log Ω/□, at 50% RH, is generally desirable for antistatic characteristics for photographic paper.

For backmark retention tests on photographic paper, a printed image is applied onto the coated papers using a dot matrix printer. The paper is then subjected to a conventional developer for 30 seconds, washed with warm water for 5 seconds and rubbed for print retention evaluation. The following ratings are assigned, with No.s 1–3 indicating acceptably good performance.

1=Outstanding, very little difference between processed and unprocessed appearance.

2=Excellent, slight degradation of appearance

3=Acceptable, medium degradation of appearance

4=Unacceptable, serious degradation of appearance

5=Unacceptable, total degradation.

For spliceability, the peel strength of the antistatic layer is measured using the same method and set-up as described earlier. Basically, a splice is made between two strips of photographic paper, with the antistatic layer of the present invention on one strip being in contact with the photographic emulsion on the other strip. Splicing is carried out using a splicing module used in commercial photofinishing equipment such as the Gretag CLAS 35 printer. The peel strength of the resultant splice is determined as stated earlier in an Instron machine. The antistatic layer is considered adequately spliceable if it provides a peel strength of at least 75–100 g and is expected to have good performance in a typical photofinishing equipment.

Peel Strength of Binder Polymers

The following list provides the details about various polymeric binders and their peel strength on polypropylene surfaces, after being modified by corona discharge treatment.

Peel strength of polymers on corona discharge treated polypropylene.

| Polymer binder | Type | Commercial name (vendor) | Peel strength of polymer on polypropylene (gms) |
|---|---|---|---|
| Polymer A | Styrene acrylate | Neocryl A5045 (Zeneca) | 793 |
| Polymer B | Polyurethane | Neorez R 9621 (Zeneca) | 1040 |
| Polymer C | Polyurethane | Neorez R 9617 (Zeneca) | 1067 |
| Polymer D | Polyurethane | Neorez R 600 (Zeneca) | 727 |
| Polymer E | Polyurethane | Witcobond 232 (Witco) | 110 |
| Polymer F | Polyurethane | Bayhydrol PR240 (Bayer) | 169 |
| Polymer G | Styrene acrylate | GA 1339 (B F Goodrich) | 40 |
| Polymer H | Styrene acrylate | as per Example 1 of Table I of U.S. Pat. No. 5,244,728 | 51 |
| Polymer I | Styrene butadiene | Nipol latex LX432A (Nippon Zeon) relevant to the styrene/butadiene copolymer latex at column 4, lines 26–34, of U.S. Pat. No. 5,232,824 | 382 |
| Polymer J | Styrene butadiene | Goodrite SB0706 (B F Goodrich), relevant to the styrene/butadiene copolymer latex at column 4, lines 26–34, of U.S. Pat. No. 5,232,824 | 137 |
| Polymer K | Styrene maleic anhydride with a compound with ethyleneimino group. | Relevant to Example 2 at column 9, line 43 to column 10, line 43 of U.S. Pat. No. 4,266,016 | 223 |

Based on the specification discussed earlier regarding the peel strength of the polymeric binder for the antistatic layer of the present invention, it is clear that such polymeric binders can include Polymers A–D but desirably not Polymers E–K because their peel strength is insufficient for application on some photographic papers.

Sample Preparation

Layers were coated from aqueous solutions of various compositions on corona discharge treated polyolefin coated photographic paper by a suitable coating technique, e.g., hopper coating, Gravure coating and wire rod coating. The polyolefin coated photographic paper included both polypropylene coated and polyethylene coated photographic paper. However, adequate performance of the antistatic layer on polypropylene coated paper can indicate excellent performance on any polyolefin coated paper including polyethylene.

The following working examples and comparative samples of antistatic layers include (i) an electrically conductive agent, which mostly include a combination of polyethylene ether glycol Carbowax 3350 supplied by Union Carbide and lithium nitrate, in a dry weight ratio of 40:60, (ii) a colloidal sol, which includes a colloidal silica, Ludox AM supplied by Du Pont, a colloidal tin oxide, Sn-15, supplied by Nyalco Products Inc. and a colloidal alumina, Al-20, supplied by Nyalco Products Inc. and (iii) a film forming polymeric binder, which includes Polymers A–K. The aqueous coating solutions were dried at a temperature less than 180° F.

The present invention is further illustrated by the following examples of its practice.

Working Examples/Comparative Samples

The following working examples, samples 1a through 3a comprising Polymer A as the polymeric binder, are formed on polypropylene coated photographic paper and samples 1b through 3b, comprising Polymer A as the polymeric binder, are formed on polyethylene coated photographic paper, as per the present invention. In each of these cases the colloidal sol is Ludox. Details about the composition and the corresponding test data for these samples are provided in Table 1. It is clear that these samples prepared as per the present invention provide good SER values, backmark retention characteristics and spliceability to be effective as antistatic layers on both polypropylene coated photographic paper and polyethylene coated photographic paper.

The following working examples, samples 4 a through 6 a comprising colloidal sol Sn-15 and sample 7 a comprising colloidal sol Al-20, are formed on polypropylene coated photographic paper, as per the present invention. In each of these cases the polymeric binder is Polymer A. Details about the composition and the corresponding test data for these samples are provided in Table 2. It is clear that these samples prepared as per the present invention provide good SER values, backmark retention characteristics and spliceability to be effective as antistatic layers on polypropylene coated photographic paper.

The following working examples, samples 8 a and 9 a comprising Polymer B as the polymeric binder, arc formed on polypropylene coated photographic paper and samples 8 b and 9 b comprising Polymer B as the polymeric binder, are formed on polyethylene coated photographic paper, as per the present invention. In each of these cases the colloidal sol is Ludox. Details about the composition and the corresponding test data for these samples are provided in Table 3. It is clear that these samples prepared as per the present invention provide good SER values, backmark retention characteristics and spliceability to be effective as antistatic layers on both polypropylene coated photographic paper and polyethylene coated photographic paper.

The following working examples, samples 10 a through 12 a comprising colloidal sol Sn-15 and sample 13 a comprising colloidal sol Al-20, are formed on polypropylene coated photographic paper, as per the present invention. In each of these cases the polymeric binder is Polymer B. Details about the composition and the corresponding test data for these samples are provided in Table 4. It is clear that these samples prepared as per the present invention provide good SER values, backmark retention characteristics and spliceability to be effective as antistatic layers on polypropylene coated photographic paper.

The following working examples, samples 14 a through 16 a comprising Polymer C as the polymeric binder, are formed on polypropylene coated photographic paper and samples 14 b through 16 b comprising Polymer C as the polymeric binder are formed on polyethylene coated photographic paper, as per the present invention. In each of these cases the colloidal sol is Ludox. Details about the composition and the corresponding test data for these samples are provided in Table 5. It is clear that these samples prepared as per the present invention provide good SER values, backmark retention characteristics and spliceability to be effective as antistatic layers on both polypropylene coated photographic paper and polyethylene coated photographic paper.

The following comparative samples 17 a (comp) and 18 a (comp) comprising Polymer F as the polymeric binder, are formed on polypropylene coated photographic paper, and comparative samples 17 b (comp) through 20 b (comp) comprising Polymer F as the polymeric binder, are formed on polyethylene coated photographic paper. In each of these cases the colloidal sol is Ludox. Note that polymer F provides a peel strength of less than 400 g on polypropylene surface, and, therefore, is not suitable for use in an antistatic layer as per the present invention. Details about the composition and the corresponding test data for these samples are provided in Table 6. It is clear that, although samples 17 b (comp) through 20 b (comp) formed on polyethylene coated photographic paper provide good SER values, backmark retention characteristics and spliceability, samples 17 a (comp) and 18 a (comp), with the same composition as samples 17 b (comp) and 18 b (comp), respectively, formed on polypropylene coated photographic paper provide much inferior properties. This illustrates the fact that antistatic layers demonstrating adequate performance on polyethylene coated photographic paper may not necessarily do so on polypropylene coated photographic paper. But a polymeric binder with a peel strength of greater than 400 g on polypropylene surface, as per the present invention, should provide excellent performance of the antistatic layer on both polypropylene coated photographic paper and polyethylene coated photographic paper.

The following comparative samples 21 a (comp) and 22 a (comp) comprising Polymer G as the polymeric binder, are formed on polypropylene coated photographic paper. In each of these cases the colloidal sol is Ludox. Note that polymer G provides a peel strength of less than 200 g on polypropylene surface. Thus, according to the present invention antistatic layers comprising polymer G are expected to provide inferior properties, especially in regards to spliceability, on photographic paper, particularly polypropylene coated photographic paper. Details about the composition and the corresponding test data for these samples are provided in Table 7. It is clear that these samples, prepared not in accordance with the present invention provide inferior properties in regards to SER and spliceability, and are not considered suitable for application on photographic paper, particularly polypropylene coated photographic paper.

The following comparative samples 23 a (comp) and 24 a (comp) comprising Polymer H as the polymeric binder, are formed on polypropylene coated photographic paper. In each of these cases the colloidal sol is Ludox. Note that polymer H provides a peel strength of less than 400 g on polypropylene surface. Thus, according to the present invention antistatic layers comprising polymer H are expected to provide inferior properties, especially in regards to spliceability, on photographic paper, particularly polypropylene coated photographic paper. Details about the composition and the corresponding test data for these samples are provided in Table 8. It is clear that these samples, prepared not in accordance with the present invention provide inferior properties in regards to spliceability, and are not considered suitable for application on photographic paper, particularly polypropylene coated photographic paper. To evaluate the teachings of U.S. Pat. No. 4,266,016, comparative samples 25 a (comp) through 27 a (comp) were formed on polypropylene coated photographic paper from the following aqueous composition, as per U.S. Pat. No. 4,266,016. The pH of this composition was 8.

| Component | weight % |
|---|---|
| 5% aqueous solution of styrene-maleic anhydride | 60 |
| 20% solution of colloidal silica | 10 |
| 5% alcoholic solution of a compound containing ethyleneimino groups | 2 |
| 10% solution of anionic surfactant | 4 |
| water | 24 |

Details about the dry coverage and corresponding test data are shown in Table 9. It is clear that, although electrically conducting, samples prepared as per U.S. Pat. No. 4,266,016, do not provide adequate spliceability or backmark retention characteristics. Additionally, comparative samples 25 a (comp) through 27 a (comp) are found to be easily scratched, and, thus, are prone to dusting, presumably due to their brittleness.

TABLE 1

| Sample | Carbowax dry wt. % | $LiNO_3$ dry wt. % | Ludox dry wt. % | Polymer A dry wt. % | Ludox: Polymer A | coverage $g/m^2$ | polyolefin surface | SER log Ω/□ | backmark retention | splice strength, g |
|---|---|---|---|---|---|---|---|---|---|---|
| 1 a | 3.1 | 4.6 | 27.7 | 64.6 | 30:70 | 0.3 | polypropylene | 10.1 | 1–2 | 209 |
| 2 a | 3.1 | 4.6 | 46.15 | 46.15 | 50:50 | 0.3 | polypropylene | 10.1 | 1 | 138 |
| 3 a | 3.1 | 4.6 | 64.6 | 27.7 | 70:30 | 0.3 | polypropylene | 9.8 | 1–2 | 81 |
| 1 b | 3.1 | 4.6 | 27.7 | 64.6 | 30:70 | 0.3 | polyethylene | 9.9 | | 1216 |
| 2 b | 3.1 | 4.6 | 46.15 | 46.15 | 50:50 | 0.3 | polyethylene | 10.1 | 1 | 994 |
| 3 b | 3.1 | 4.6 | 64.6 | 27.7 | 70:30 | 0.3 | polyethylene | 9.6 | | 829 |

TABLE 2

| Sample | Carbowax dry wt. % | $LiNO_3$ dry wt. % | Sn-15 dry wt. % | Polymer A dry wt. % | Sn-15: Polymer A | coverage $g/m^2$ | polyolefin surface | SER log Ω/□ | backmark retention | splice strength, g |
|---|---|---|---|---|---|---|---|---|---|---|
| 4 a | 3.1 | 4.6 | 23.1 | 69.2 | 25:75 | 0.3 | polypropylene | 10.9 | 1–2 | 272 |
| 5 a | 3.1 | 4.6 | 46.15 | 46.15 | 50:50 | 0.3 | polypropylene | 9.9 | 1-2 | 450 |
| 6 a | 3.1 | 4.6 | 69.2 | 23.1 | 75:25 | 0.3 | polypropylene | 9.9 | 1 | 729 |

TABLE 2-continued

| Sample | Carbowax dry wt. % | $LiNO_3$ dry wt. % | Al-20 dry wt. % | Polymer A dry wt. % | Al-20: Polymer A | coverage $g/m^2$ | polyolefin surface | SER log Ω/□ | backmark retention | splice strength, g |
|---|---|---|---|---|---|---|---|---|---|---|
| 7a | 3.1 | 4.6 | 46.15 | 46.15 | 50:50 | 0.3 | polypropylene | 10 | 1 | 219 |

TABLE 3

| Sample | Carbowax dry wt. % | $LiNO_3$ dry wt. % | Ludox dry wt. % | Polymer B dry wt. % | Ludox: Polymer B | coverage $g/m^2$ | polyolefin surface | SER log Ω/□ | backmark retention | splice strength, g |
|---|---|---|---|---|---|---|---|---|---|---|
| 8 a | 3.1 | 4.6 | 46.15 | 46.15 | 50:50 | 0.3 | polypropylene | 10.2 | 1 | 348 |
| 9 a | 3.1 | 4.6 | 64.6 | 27.7 | 70:30 | 0.3 | polypropylene | 9.7 | 1–2 | 112 |
| 8 b | 3.1 | 4.6 | 46.15 | 46.15 | 50:50 | 0.3 | polyethylene | 9.9 | 1 | 1155 |
| 9 b | 3.1 | 4.6 | 64.6 | 27.7 | 70:30 | 0.3 | polyethylene | 9.9 | | |

TABLE 4

| Sample | Carbowax dry wt. % | $LiNO_3$ dry wt. % | Sn-15 dry wt. % | Polymer B dry wt. % | Sn-15: Polymer B | coverage $g/m^2$ | polyolefin surface | SER log Ω/□ | backmark retention | splice strength, g |
|---|---|---|---|---|---|---|---|---|---|---|
| 10 a | 3.1 | 4.6 | 23.1 | 69.2 | 25:75 | 0.3 | polypropylene | 11.7 | 1–2 | 307 |
| 11 a | 3.1 | 4.6 | 46.15 | 46.15 | 50:50 | 0.3 | polypropylene | 10.3 | 1–2 | 285 |
| 12 a | 3.1 | 4.6 | 69.2 | 23.1 | 75:25 | 0.3 | polypropylene | 10 | 1–2 | 183 |
| **Sample** | **Carbowax dry wt. %** | **$LiNO_3$ dry wt. %** | **Al-20 dry wt. %** | **Polymer B dry wt. %** | **Al-20: Polymer B** | **coverage $g/m^2$** | **polyolefin surface** | **SER log Ω/□** | **backmark retention** | **splice strength, g** |
| 13 a | 3.1 | 4.6 | 69.2 | 23.1 | 75:25 | 0.3 | polypropylene | 9 | 1 | 98 |

TABLE 5

| Sample | Carbowax dry wt. % | $LiNO_3$ dry wt. % | Ludox dry wt. % | Polymer C dry wt. % | Ludox: Polymer C | coverage $g/m^2$ | polyolefin surface | SER log Ω/□ | backmark retention | splice strength, g |
|---|---|---|---|---|---|---|---|---|---|---|
| 14 a | 3.1 | 4.6 | 27.7 | 64.6 | 30:70 | 0.3 | polypropylene | 9.3 | | |
| 15 a | 3.1 | 4.6 | 46.15 | 46.15 | 50:50 | 0.3 | polypropylene | 8.5 | 1 | 1175 |
| 16 a | 3.1 | 4.6 | 64.6 | 27.7 | 70:30 | 0.3 | polypropylene | 8.9 | | |
| 14 b | 3.1 | 4.6 | 27.7 | 64.6 | 30:70 | 0.3 | polyethylene | 9.9 | | |
| 15 b | 3.1 | 4.6 | 46.15 | 46.15 | 50:50 | 0.3 | polyethylene | 8.6 | 1 | 1091 |
| 16 b | 3.1 | 4.6 | 64.6 | 27.7 | 70:30 | 0.3 | polyethylene | 9.4 | | |

TABLE 6

| Sample | Carbowax dry wt. % | $LiNO_3$ dry wt. % | Ludox dry wt. % | Polymer F dry wt. % | Ludox: Polymer F | coverage $g/m^2$ | polyolefin surface | SER log Ω/□ | backmark retention | splice strength, g |
|---|---|---|---|---|---|---|---|---|---|---|
| 17 a (comp) | 3.1 | 4.6 | 46.15 | 46.15 | 50:50 | 0.3 | polypropylene | 10.6 | 4 | 41 |
| 18 a (comp) | 3.1 | 4.6 | 64.6 | 27.7 | 70:30 | 0.3 | polypropylene | 9.8 | | 43 |
| 17 b (comp) | 3.1 | 4.6 | 46.15 | 46.15 | 50:50 | 0.3 | polyethylene | 11 | 1 | 428 |
| 18 b (comp) | 3.1 | 4.6 | 64.6 | 27.7 | 70:30 | 0.3 | polyethylene | 9.7 | | |
| 19 b (comp) | 4.0 | 6.0 | 72 | 18 | 80:20 | 0.3 | polyethylene | 9.7 | 2–3 | 253 |
| 20 b (comp) | 4.0 | 6.0 | 58.5 | 31.5 | 65:35 | 0.3 | polyethylene | 10.4 | 2–3 | 283 |

TABLE 7

| Sample | Carbowax dry wt. % | $LiNO_3$ dry wt. % | Ludox dry wt. % | Polymer G dry wt. % | Ludox: Polymer G | coverage g/m$^2$ | polyolefin surface | SER log Ω/□ | backmark retention | splice strength, g |
|---|---|---|---|---|---|---|---|---|---|---|
| 21 a (comp) | 3.1 | 4.6 | 27.7 | 64.6 | 30:70 | 0.3 | polypropylene | 13.5 | | |
| 22 a (comp) | 3.1 | 4.6 | 46.15 | 46.15 | 50:50 | 0.3 | polypropylene | 10.1 | 1 | 33 |

TABLE 8

| Sample | Carbowax dry wt. % | $LiNO_3$ dry wt. % | Ludox dry wt. % | Polymer H dry wt. % | Ludox: Polymer H | coverage g/m$^2$ | polyolefin surface | SER log Ω/□ | backmark retention | splice strength, g |
|---|---|---|---|---|---|---|---|---|---|---|
| 23 a (comp) | 3.1 | 4.6 | 27.7 | 64.6 | 30:70 | 0.3 | polypropylene | 9.4 | | 26 |
| 24 a (comp) | 3.1 | 4.6 | 64.6 | 27.7 | 70:30 | 0.3 | polypropylene | 9.0 | | 34 |

TABLE 9

| Sample | coverage g/m$^2$ | polyolefin surface | SER log Ω/□ | backmark retention | splice strength, g |
|---|---|---|---|---|---|
| 25 a (comp) | 0.3 | poly-propylene | 10.8 | 5 | <20 |
| 26 a (comp) | 0.5 | poly-propylene | 10.6 | | <20 |
| 27 a (comp) | 1.0 | poly-propylene | 10.8 | | <20 |

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A photographic element having an antistatic layer comprising a polymeric film-forming binder, wherein the binder has a peel strength of 700 g or greater on a polypropylene surface.

2. The photographic element according to claim 1, further comprising:

a support having at least one polyolefin layer on at least one side; and at least one silver halide emulsion layer superposed on either the first side or second side of said support wherein the antistatic layer further comprises a conductive agent and optionally a colloidal sol, and is superposed on the first or second side of the support.

3. The photographic clement of claim 2, wherein the conductive agent comprises alkali metal salts of polyacids or cellulose derivatives.

4. The photographic element of claim 2, wherein the conductive agent comprises polymerized alkylene oxides and alkali metal salts.

5. The photographic element of claim 4, wherein the dry weight ratio of the alkylene oxide to alkali metal salt in the antistatic layer is from 5:95 to 95:5 and the polyolefin layer is polypropylene or polyethylene.

6. The photographic element of claim 2, wherein the dry weight ratio of the colloidal sol to the polymeric film forming binder is from 0:100 to 95:5.

7. The photographic element of claim 1, wherein the dry coverage of the antistatic layer is from 10 mg/m$^2$ to 10,000 mg/m$^2$.

8. The photographic element of claim 1, wherein the polymeric film-forming binder comprises a water soluble polymer, a hydrophilic colloid, or a water insoluble polymer latex or dispersion.

9. The photographic element of claim 2, wherein the colloidal sol comprises surface-hydroxylated aluminum modified colloidal dispersion of silica in aqueous medium with a partial substitution of aluminum for silicon.

10. The photographic element of claim 2, wherein the particles of the colloidal sol have an average particle size of less than 50 nm.

11. The photographic element of claim 1, wherein the antistatic layer further comprises colorants, crosslinking agents, surfactants, coating aids, defoamers, thickeners, coalescing aids, matte beads, lubricants, pH adjusting agents or combinations thereof.

12. A photographic element comprising:

a support having a polyolefin coating on at least one side;

at least one silver halide emulsion layer superposed on the first side of said support;

an antistatic layer superposed on the second side of the support, said antistatic layer comprising:

a conductive agent comprising an alkali metal salt and a polymerized alkylene oxide, an aluminum modified colloidal silica, and a polymeric film-forming binder having a peel strength of 700 g or greater on a polypropylene surface.

13. A photographic paper comprising the photographic element according to claim 12.

14. A photographic element comprising:

a paper base;

at least one photosensitive silver halide layer superposed on a first side of said paper base;

a biaxially oriented polyolefin sheet having one or more polyolefin layers between the first side of said paper base and said at least one silver halide layer wherein said biaxially oriented polyolefin sheet comprises a layer of polyethylene or polypropylene polymer that bonds to gelatin;

an antistatic layer superposed on a second side of the paper base, said antistatic layer comprising a conductive agent comprising:

an alkali metal salt and a polymerized alkylene oxide, an aluminum modified colloidal silica, a polymeric film-forming binder having a peel strength of 700 g or greater on a polypropylene surface; and a polyolefin layer between the second side of the paper base and the antistatic layer.

15. The photographic element of claim 2, wherein the colloidal sol is metal oxide colloidal sol and the polyolefin layer is polypropylene or polyethylene.

16. The photographic element of claim 2, wherein the colloidal sol is a sol of tin oxide, antimony oxide, zircon, silica, alumina-coated silica, boehmite, an inorganic oxide of Group III or IV, or combinations thereof.

17. The photographic element of claim 2, wherein the colloidal sol is a sol of silicon nitride, silicon carbide, magnesium fluoride, or combinations thereof.

* * * * *